US006689976B1

(12) United States Patent
Dove et al.

(10) Patent No.: US 6,689,976 B1
(45) Date of Patent: Feb. 10, 2004

(54) ELECTRICALLY ISOLATED LIQUID METAL MICRO-SWITCHES FOR INTEGRALLY SHIELDED MICROCIRCUITS

(75) Inventors: Lewis R Dove, Monument, CO (US); John F Casey, Colorado Springs, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/266,872

(22) Filed: Oct. 8, 2002

(51) Int. Cl.[7] ..... H01H 29/00

(52) U.S. Cl. ..... 200/182; 200/187; 200/215; 200/216; 200/233

(58) Field of Search ..... 200/182, 183, 200/187–194, 199, 214–236

(56) References Cited

U.S. PATENT DOCUMENTS 4,419,650 A * 12/1983 John ..... 337/119
5,751,552 A 5/1998 Scanlan et al.
5,886,407 A 3/1999 Polese
5,972,737 A 10/1999 Polese
6,323,447 B1 * 11/2001 Kondoh et al. ..... 200/182
6,373,356 B1 4/2002 Gutierrez
6,470,106 B2 * 10/2002 McClelland et al. ..... 385/16
6,512,322 B1 1/2003 Wong
6,515,404 B1 2/2003 Wong

FOREIGN PATENT DOCUMENTS

JP 9161640 A 6/1997
SH 36-18575 10/1961
SH 47-21645 10/1972

OTHER PUBLICATIONS

Joonwon Kim et al., "A Micromechanical Switch With Electrostatically Driven Liquid–Metal Droplet", Sensors and Actuators, A: Physical. v 9799, Apr. 1, 2002, 4 pages.

* cited by examiner

*Primary Examiner*—Ramon M. Barrera

(57) ABSTRACT

Liquid metal micro-switches. Liquid metal micro-switches and techniques for fabricating them in integrally shielded microcircuits are disclosed. The liquid metal micro-switches can be integrated directly into the construction of shielded thick film microwave modules. This integration is useful in applications requiring high frequency switching with high levels of electrical isolation.

22 Claims, 10 Drawing Sheets

ELECTRICALLY ISOLATED LIQUID METAL MICRO-SWITCHES FOR INTEGRALLY SHIELDED MICROCIRCUITS

FIELD OF THE INVENTION

The present invention relates generally to the field of radio-frequency and microwave microcircuit modules, and more particularly to liquid metal micro-switches used in such modules.

BACKGROUND OF THE INVENTION

Microwaves are electromagnetic energy waves with very short wavelengths, typically ranging from a millimeter to 30 centimeters peak to peak. In high-speed communications systems, microwaves are used as carrier signals for sending information from point A to point B. Information carried by microwaves is transmitted, received, and processed by microwave circuits.

Packaging of radio frequency (RF) and microwave microcircuits has traditionally been very expensive and has required very high electrical isolation and excellent signal integrity through gigahertz frequencies. Additionally, integrated circuit (IC) power densities can be very high. Microwave circuits require high frequency electrical isolation between circuit components and between the circuit itself and other electronic circuits. Traditionally, this need for isolation has resulted in building the circuit on a substrate, placing the circuit inside a metal cavity, and then covering the metal cavity with a metal plate. The metal cavity itself is typically formed by machining metal plates and then attaching multiple plates together with solder or an epoxy. The. plates can also be cast, which is a cheaper alternative to machined plates. However, accuracy is sacrificed with casting.

One problem attendant with the more traditional method of constructing microwave circuits is that the method of sealing the metal cover to the cavity uses conductive epoxy. While the epoxy provides a good seal, it comes with the cost of a greater electrical resistance, which increases the loss in resonant cavities and increases leakage in shielded cavities. Another problem with the traditional method is the fact that significant assembly time is required, thereby increasing manufacturing costs.

Another traditional approach to packaging RF/microwave microcircuits has been to attach gallium arsenic (GaAs) or bipolar integrated circuits and passive components to thin film circuits. These circuits are then packaged in the metal cavities discussed above. Direct current feed-through connectors and RF connectors are then used to connect the module to the outside world.

Still another method for fabricating an improved RF microwave circuit is to employ a single-layer thick film technology substrate in place of the thin film circuits. While some costs are slightly reduced, the overall costs remain high due to the metallic enclosure and its connectors, and the dielectric materials typically employed (e.g., pastes or tapes) in this type of configuration are electrically lossy, especially at gigahertz frequencies. The dielectric constant is poorly controlled as a function of frequency. In addition, controlling the thickness of the dielectric material often proves difficult.

A more recent method for constructing completely shielded microwave modules using only thick film processes without metal enclosures is disclosed by Lewis R. Dove, et al. in U.S. Pat. No. 6,255,730 entitled "Integrated Low Cost Thick Film RF Module", hereinafter Dove. Dove discloses an integrated low cost thick film RF module and method for making same. An improved thick film dielectric is employed to fabricate three-dimensional, high frequency structures. The dielectrics used (KQ-120 and KQ-CL907406) are available from Heraeus Cermalloy, 24 Union Hill Road, West Conshohocken, Pa. These dielectrics can be utilized to create RF and microwave modules that integrate the I/O and electrical isolation functions of traditional microcircuits without the use of previous more expensive components.

Electronic circuits of all construction types typically have need of switches and relays. The typical compact, mechanical contact type relay is a lead relay. A lead relay comprises a lead switch, in which two leads composed of a magnetic alloy are contained, along with an inert gas, inside a miniature glass vessel. A coil for an electromagnetic drive is wound around the lead switch, and the two leads are installed within the glass vessel as either contacting or non-contacting.

Lead relays include dry lead relays and wet lead relays. Usually with a dry lead relay, the ends (contacts) of the leads are composed of silver, tungsten, rhodium, or an alloy containing any of these, and the surfaces of the contacts are plated with rhodium, gold, or the like. The contact resistance is high at the contacts of a dry lead relay, and there is also considerable wear at the contacts. Since reliability is diminished if the contact resistance is high at the contacts or if there is considerable wear at the contacts, there have been various attempts to treat the surface of these contacts.

Reliability of the contacts may be enhanced by the use of mercury with a wet lead relay. Specifically, by covering the contact surfaces of the leads with mercury, the contact resistance at the contacts is decreased and the wear of the contacts is reduced, which results in improved reliability. In addition, because the switching action of the leads is accompanied by mechanical fatigue due to flexing, the leads may begin to malfunction after some years of use.

A newer type of switching mechanism is structured such that a plurality of electrodes are exposed at specific locations along the inner walls of a slender sealed channel that is electrically insulating. This channel is filled with a small volume of an electrically conductive liquid to form a short liquid column. When two electrodes are to be electrically closed, the liquid column is moved to a location where it is simultaneously in contact with both electrodes. When the two electrodes are to be opened, the liquid column is moved to a location where it is not in contact with both electrodes at the same time.

To move the liquid column, Japanese Laid-Open Patent Application SHO 47-21645 discloses creating a pressure differential across the liquid column is created. The pressure differential is created by varying the volume of a gas compartment located on either side of the liquid column, such as with a diaphragm.

In another development, Japanese Patent Publication SHO 36-18575 and Japanese Laid-Open Patent Application HEI 9-161640 disclose creating a pressure differential across the liquid column by providing the gas compartment with a heater. The heater heats the gas in the gas compartment located on one side of the liquid column. The technology disclosed in Japanese Laid-Open Patent Application 9-161640 (relating to a microrelay element) can also be applied to an integrated circuit. Other aspects are discussed by J. Simon, et al. in the article "A Liquid-Filled Microrelay with a Moving Mercury Drop" published in the Journal of Microelectromechanical Systems, Vol.6, No. 3, September 1997. Disclosures are also made by You Kondoh et al. in U.S. Pat. No. 6,323,447 entitled "Electrical Contact Breaker Switch, Integrated Electrical Contact Breaker Switch, and Electrical Contact Switching Method".

There remains a need for an electrically isolated liquid metal micro-switch for use in an integrally shielded high-frequency microcircuit.

SUMMARY OF THE INVENTION

The present patent document relates to techniques for fabricating electrically isolated liquid metal micro-switches in integrally shielded microcircuits. Disclosures made herein provide means by which liquid metal micro-switches can be integrated directly into the construction of shielded thick film microwave modules.

In a representative embodiment, a liquid metal micro-switch comprises a first substrate and a first ground plane which is attached to the first substrate. A first dielectric layer is attached to the first ground plane. A conductive signal layer is attached to the first dielectric layer and patterned so as to define first, second, and third signal conductors having respectively first, second, and third micro-switch contacts. A second dielectric layer is attached to the signal layer conductors and to the first dielectric layer a second ground plane is attached to the second dielectric layer. A second substrate is attached to the second dielectric layer and has a cavity. A third ground plane is attached to the second substrate. A heater is positioned inside the cavity. A main channel is partially filled with a liquid metal, wherein the main channel encompasses the micro-switch contacts. A sub-channel connects the cavity and main channel, wherein a gas fills the cavity and sub-channel and wherein heater activation forces an open circuit between first and second micro-switch contacts and a short circuit between second and third micro-switch contacts.

In another representative embodiment, a liquid metal micro-switch comprises a first substrate and a first ground plane, wherein the first ground plane is attached to the first substrate. A first dielectric layer is attached to the first ground plane. A conductive signal layer is attached to the first dielectric layer and patterned so as to define first, second, and third signal conductors, wherein the first, second, and third signal conductors have respectively first, second, and third micro-switch contacts. A second ground plane is attached to a second substrate. A second dielectric layer is attached to the second substrate, has a cavity, and is attached to the first dielectric layer. A heater is positioned inside the cavity. A main channel is partially filled with a liquid metal with the main channel encompassing the micro-switch contacts. A sub-channel connects the cavity and main channel with a gas filling the cavity and sub-channel, wherein heater activation forces an open circuit between first and second micro-switch contacts and a short circuit between second and third micro-switch contacts.

In still another representative embodiment, a method for fabricating a liquid metal micro-switch comprises attaching a first ground plane to a first substrate, attaching a first dielectric layer to the first ground plane, and attaching a conductive signal layer to the first dielectric layer. The conductive signal layer is patterned so as to define first, second, and third signal conductors which have respectively first, second, and third micro-switch contacts. A second dielectric layer is attached to first, second, and third signal conductors and to the first dielectric layer. The second dielectric layer is patterned so as to define at least one sub-channel and a main channel. A second ground plane is attached to the second dielectric layer. A cavity is created in a second substrate. A third ground plane is attached to the second substrate. A heater is attached inside the cavity. The main channel is partially filled with a liquid metal, wherein the main channel encompasses the micro-switch contacts. The second substrate and the third ground plane are attached to the second ground plane and the second dielectric layer.

In yet another representative embodiment, a method for fabricating a liquid metal micro-switch comprises attaching a first ground plane to a first substrate, attaching a first dielectric layer to the first ground plane, and attaching a conductive signal layer to the first dielectric layer. The conductive signal layer is patterned so as to define first, second, and third signal conductors having respectively first, second, and third micro-switch contacts. A second ground plane is attached to a second substrate. A second dielectric layer is attached to the second substrate. The second dielectric layer is patterned so as to define a cavity, at least one sub-channel, and a main channel. A second dielectric layer is attached to first, second, and third signal conductors and to the first dielectric layer. A heater is attached inside the cavity. The main channel is partially filled with a liquid metal, wherein the main channel encompasses the micro-switch contacts. The second dielectric layer is attached to the conductive signal layer and to the first dielectric layer.

Other aspects and advantages of the present invention will become apparent from the following detailed description, taken in conjunction with the accompanying drawings, illustrating by way of example the principles of the invention.

BRIEF DESCRIPTION OF THE DRAWINGS

The accompanying drawings provide visual representations which will be used to more fully describe the invention and can be used by those skilled in the art to better understand it and its inherent advantages. In these drawings, like reference numerals identify corresponding elements.

DETAILED DESCRIPTION OF THE PREFERRED EMBODIMENTS

Figure 1A:
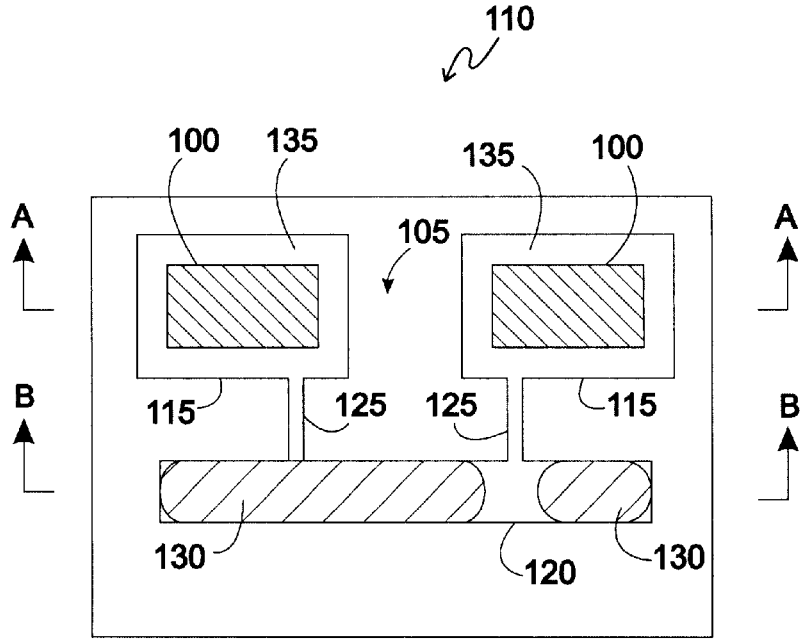
FIG. 1A is a drawing of a top view of a heater actuated, liquid metal micro-switch in a microcircuit.

As shown in the drawings for purposes of illustration, the present patent document relates to techniques for fabricating electrically isolated liquid metal micro-switches in integrally shielded microcircuits. Disclosures made herein provide means by which liquid metal micro-switches can be integrated directly into the construction of shielded thick film microwave modules.

In the following detailed description and in the several figures of the drawings, like elements are identified with like reference numerals.

FIG. 1A is a drawing of a top view of a heater 100 actuated, liquid metal micro-switch 105 in a microcircuit 110. Dimensions in the figures are not to scale. The microcircuit 110 of FIG. 1A is more generally referred to as electronic circuit 110. The electronic circuit 110 of FIG. 1A is preferably fabricated using thin film deposition techniques and/or thick film screening techniques which could comprise either single-layer or multi-layer ceramic circuit substrates. While the only component shown in the microcircuit 110 in FIG. 1A is the liquid metal micro-switch 105, it will be understood by one of ordinary skill in the art that other components can be fabricated as a part of the microcircuit 110. In FIG. 1A, the liquid metal micro-switch 165 comprises two heaters 100 located in separate cavities 115. The heaters 100 could be, for example, monolithic heaters 100 fabricated using conventional silicon integrated circuit methods. The cavities 115 are each connected to a main channel 120 via separate sub-channels 125. The main channel 120 is partially filled with a liquid metal 130 which could be for example mercury 130, an alloy comprising gallium 130, or other appropriate liquid. The cavities 115, the sub-channels 125, and that part of the main channel 120 not filled with the liquid metal 130 is filled with a gas 135, which is preferably an inert gas such as nitrogen 135. In the switch state shown in FIG. 1A, the mercury 130 is divided into two pockets of unequal volumes. Note that the left hand volume in FIG. 1A is greater than that of the right hand volume. The functioning of the liquid metal micro-switch 105 will be explained in the following paragraphs.

Figure 1B:
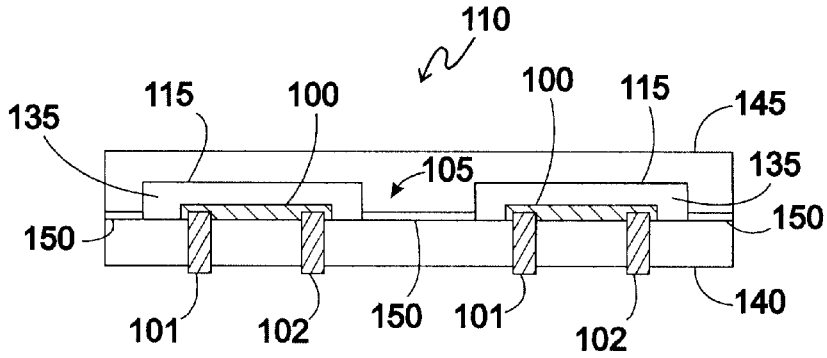
FIG. 1B is a drawing of a side view of the heater actuated, liquid metal micro-switch at section A—A of FIG. 1A.

FIG. 1B is a drawing of a side view of the heater 100 actuated, liquid metal micro-switch 105 at section A—A of FIG. 1A. Section A—A is taken along a plane passing through the heaters 100. In FIG. 1B, the heaters 100 are mounted to a substrate 140, also referred to herein as a first substrate 140, upon which the microcircuit 110 is fabricated. A lid 145, which is sealed at mating surfaces 150, covers the liquid metal micro-switch 105. Electrical contact is made separately to the heaters 100 via first and second heater contacts 101,102 to each of the heaters 100. An electric current passed through the left side heater 100 will cause the gas 135 in the left side cavity 115 to expand. This expansion continues as part of the gas enters the main channel 120 via the left side sub-channel 125.

Figure 1C:
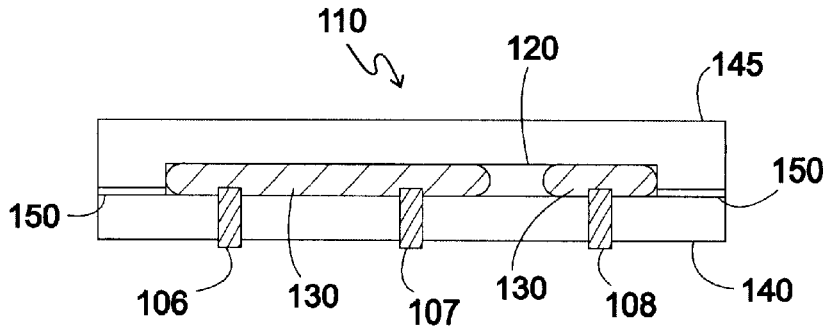
FIG. 1C is a drawing of a side view of the heater actuated, liquid metal micro-switch at section B—B of FIG. 1A.

FIG. 1C is a drawing of a side view of the heater 100 actuated, liquid metal micro-switch 105 at section B—B of FIG. 1A. Section B—B is taken along a plane passing through the main channel 120. The liquid metal 130 on the left side of FIG. 1C being larger in volume than that on the right side electrically shorts together a first and second micro-switch contacts 106,107 of the liquid metal micro-switch 105, while the volume of the liquid metal 130 on the right side of FIG. 1C being the smaller, a third micro-switch contact 108 also on the right side of FIG. 1C forms an open-circuit.

Figure 2A:
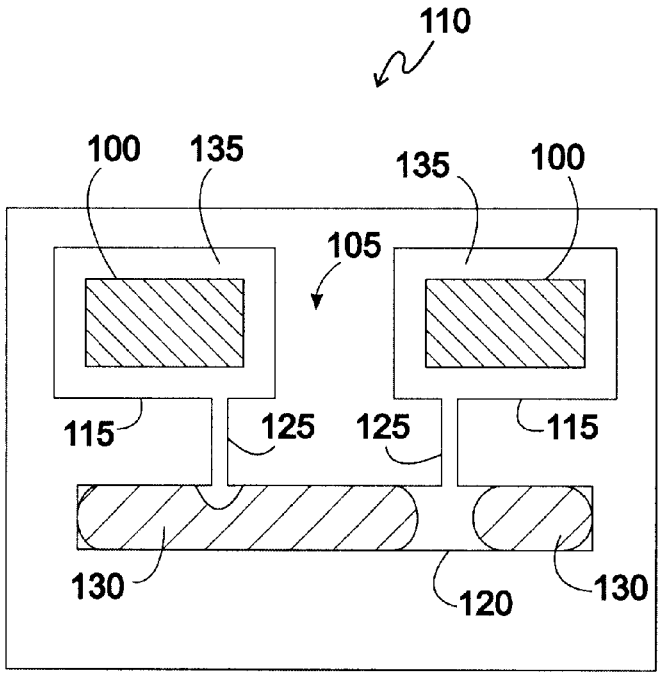
FIG. 2A is another drawing of the top view of the heater actuated, liquid metal micro-switch in the microcircuit.

FIG. 2A is another drawing of the top view of the heater 100 actuated, liquid metal micro-switch 105 in the microcircuit 110. FIG. 2A shows the condition of the liquid metal micro-switch 105 shortly after the left side heater 100 has been activated. In this condition, the gas 135 in the left side cavity 115 has been heated just enough to begin forcing, at the interface between the main channel 120 and the left side sub-channel 125, a part of the liquid metal 130 on the left side of the main channel 120 toward the right side of the main channel 120.

Figure 2B:
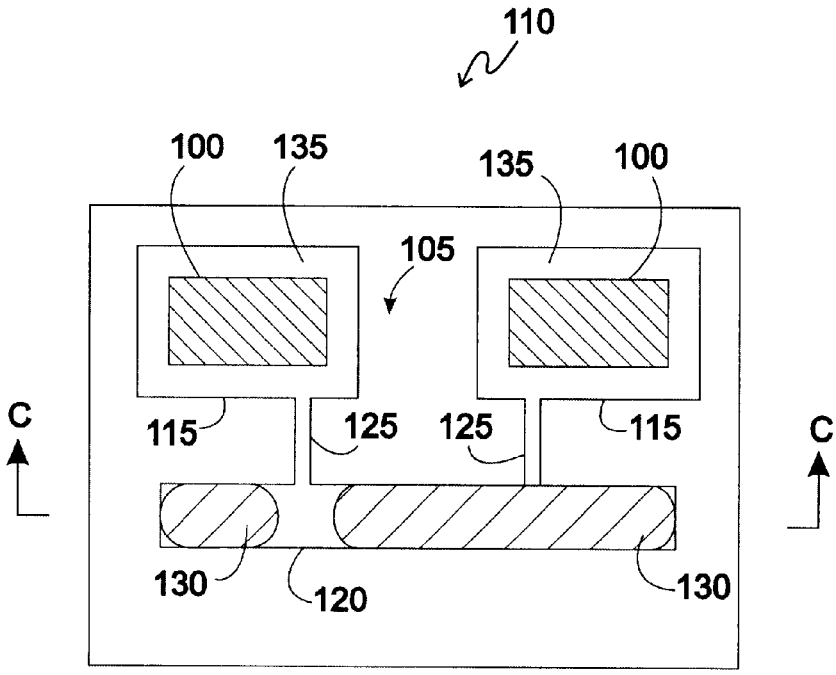
FIG. 2B is still another drawing of the top view of the heater actuated, liquid metal micro-switch in the microcircuit.

FIG. 2B is still another drawing of the top view of the heater 100 actuated, liquid metal micro-switch 105 in the microcircuit 110. FIG. 2B shows the condition of the liquid metal micro-switch 105 after the left side heater 100 has been fully activated. In this condition, the gas 135 in the left side cavity 115 has been heated enough to force a part of the liquid metal 130 originally on the left side of the main channel 120 into the right side of the main channel 120.

Figure 2C:
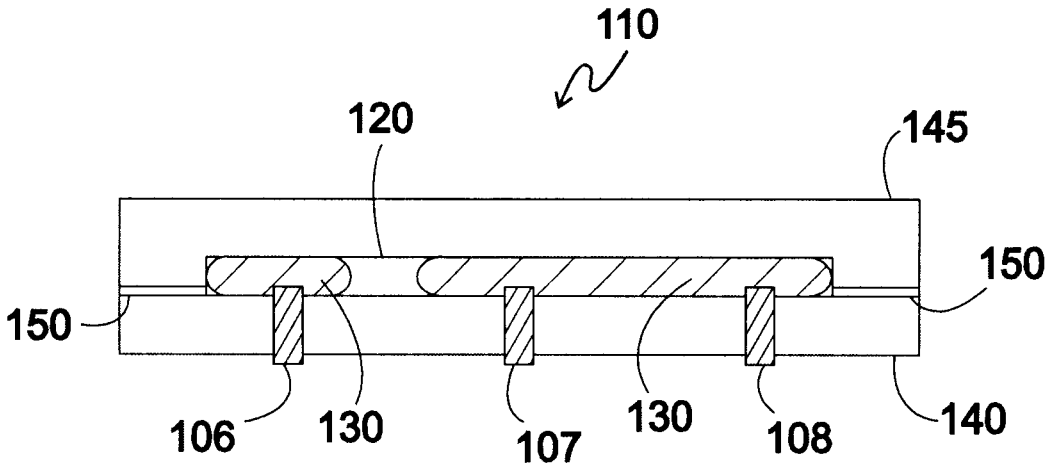
FIG. 2C is a drawing of a side view of the heater actuated, liquid metal micro-switch at section C—C of FIG. 2B.

FIG. 2C is a drawing of a side view of the heater 100 actuated, liquid metal micro-switch 105 at section C—C of FIG. 2B. Section C—C is taken along a plane passing through the main channel 120. The liquid metal 130 on the right side of FIG. 1C now electrically shorts the second and third micro-switch contacts 107,108 of the liquid metal micro-switch 105 while the first micro-switch contact 106 on the left side of FIG. 2C now forms an open-circuit.

Figure 3:
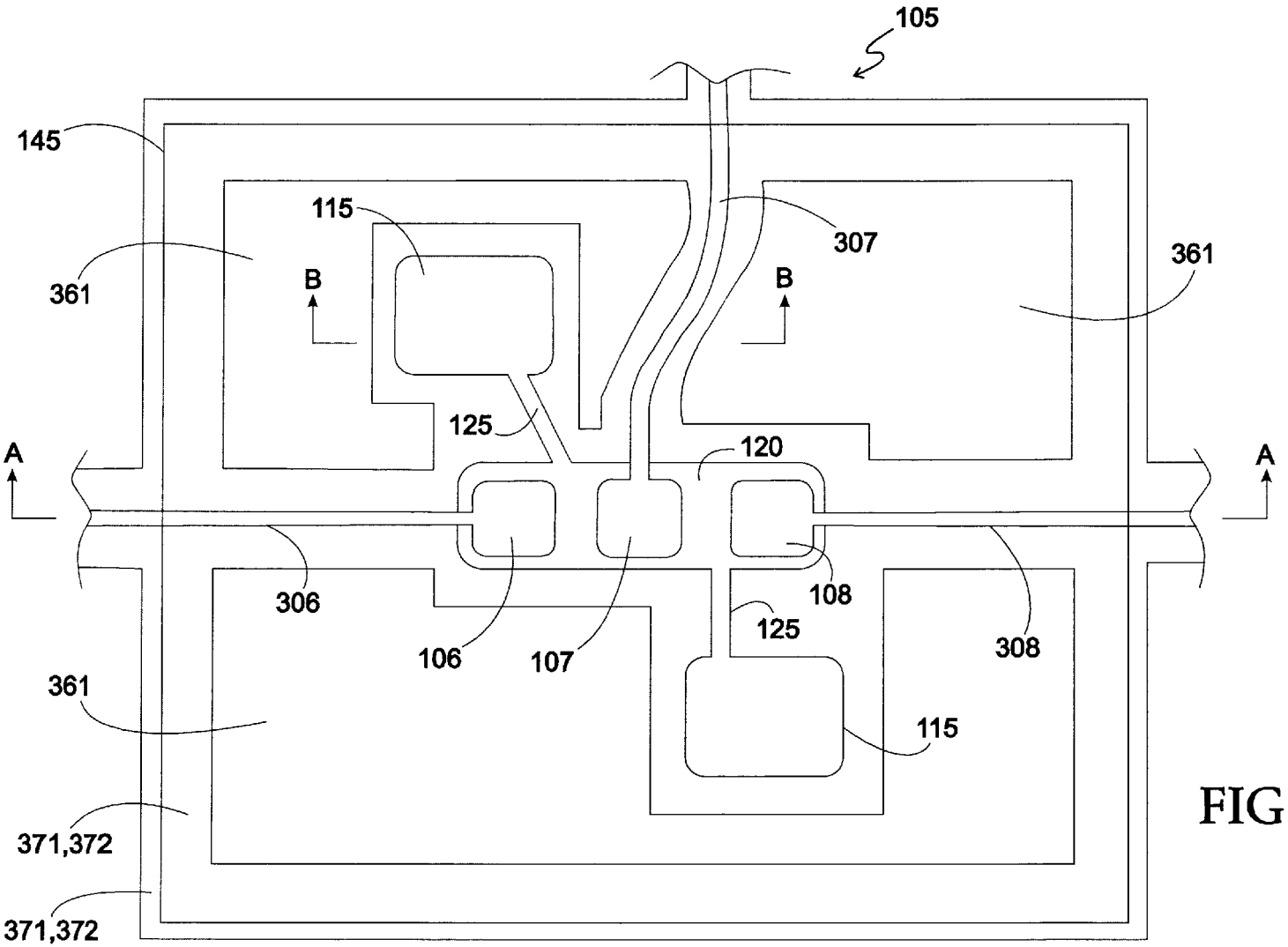
FIG. 3 is a detailed drawing of a top view of a heater actuated, liquid metal micro-switch as described in various representative embodiments consistent with the teachings of the invention.

FIG. 3 is a detailed drawing of a top view of a heater actuated, liquid metal micro-switch 105 as described in various representative embodiments consistent with the teachings of the invention. In FIG. 3, heater cavities 115 are connected to a main channel 120 through sub-channels 125. First, second, and third micro-switch contacts 106,107,108 are electrically connected to the remainder of the microcircuit 110 by means of electrical connection to first, second, and third signal conductors 306,307,308 respectively which form the central conductors of integrally shielded quasi-coax transmission lines. Also, shown in FIG. 3 is an exposed portion of a first ground plane 361 with first and/or second dielectric layers 371,372 respectively on top of the first ground plane 361. For illustrative purposes, a reference outline of a lid 145, also referred to herein as a second substrate 145 and which is typically glass is shown. Again, dimensions in the figures are not to scale.

Figure 4:
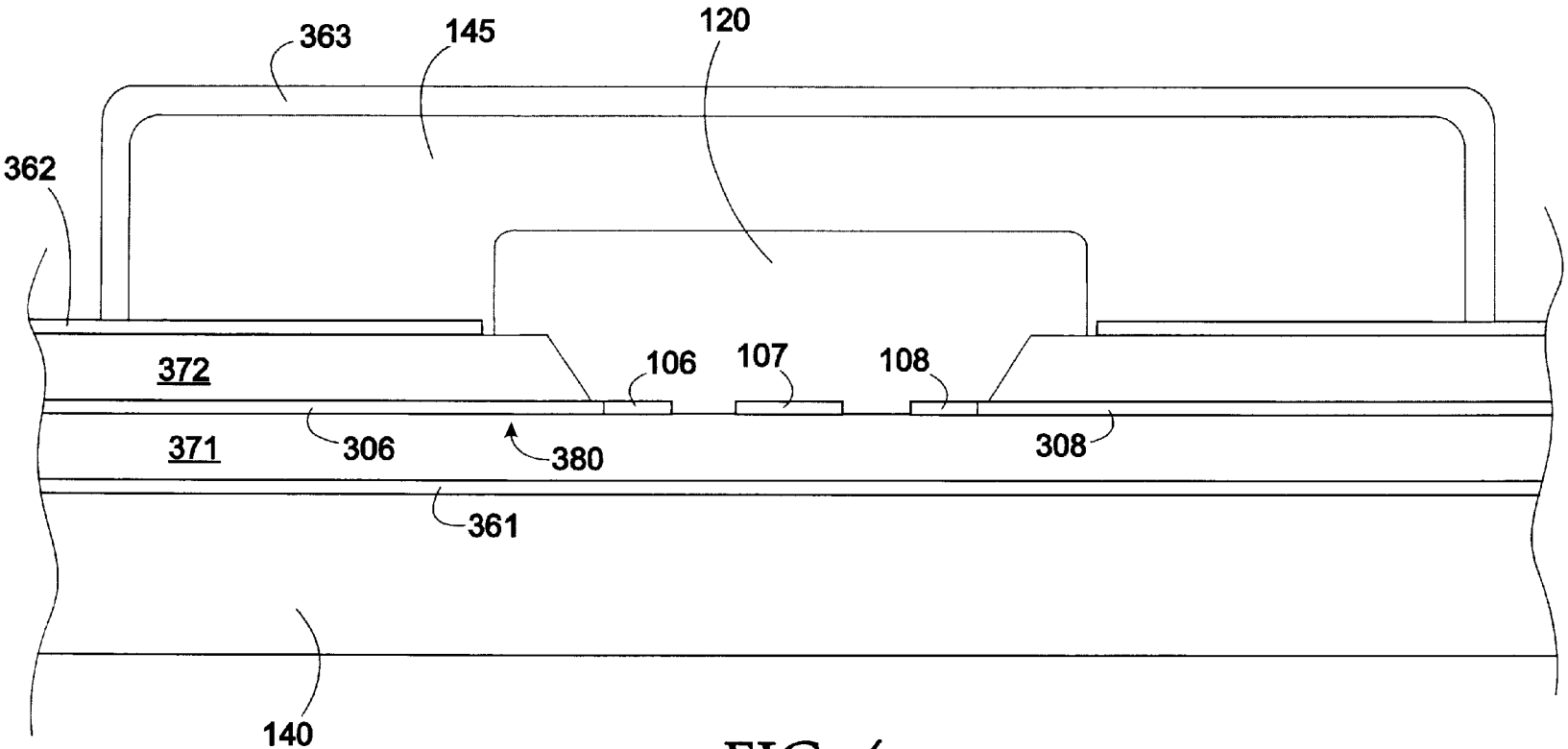
FIG. 4 is a drawing of a side view of the heater actuated, liquid metal micro-switch at section A—A of FIG. 3.

FIG. 4 is a drawing of a side view of the heater 100 actuated, liquid metal micro-switch 105 at section A—A of FIG. 3. FIG. 4 shows a cross-section of the micro-switch 105 taken through the main channel 120. In FIG. 4, the first ground plane 361 is attached to a first substrate 140. The first dielectric layer 371 is attached to the first ground plane 361. A conductive signal layer 380 comprising the first, second, and third signal conductors 306,307,308 connected respectively to the first, second, and third micro-switch contacts 106,107,108 is attached to the first dielectric layer 371. The second signal conductor 307 is not shown in FIG. 4 but is shown in previous figures. A second dielectric layer 372 is then attached to the first dielectric layer 371 and the conductive signal layer 380 as determined by patterning of the conductive signal layer 380. A second ground plane 362 is attached to the second dielectric layer 372 and wraps around the structure to form a complete electrical shield. The second substrate 145 is attached to the second ground plane 362. A third ground plane 363 is attached to the second substrate 145 and electrically connected to the second ground plane 362. The main channel 120 has been formed in the second substrate 145. Not shown in FIG. 4 is the liquid metal 130 which depending upon the configuration of the micro-switch 105 forms a short circuit between first and second micro-switch contacts 106,107 or between second and third micro-switch contacts 107,108.

The first ground plane 361 is preferably printed on top of the first substrate 140 which is preferably fabricated from ceramic. In a representative embodiment, the first substrate 140 is a mechanical carrier for the microcircuit 110 but does not provide signal propagation support, as is the case with conventional microcircuits. Various techniques are available for the placement and patterning of the dielectric layers 371,372, the conductive signal layer 380, and the ground planes 361,362,363. Preferably the dielectric layers 371,372, the conductive signal layer 380, and the first and second ground planes 361,362 are deposited via thick film techniques, patterns are defined photo-lithographically, and the layers etched to form the desired patterns. The dielectric materials are preferably KQ-120 or KQ-CL907406 mentioned above. FIG. 4 shows the top side of the second substrate 145 plated with metal creating the third ground plane 363 which is electrically connected to the microcircuit's second ground plane 362. The second substrate 145 is preferably hermetically sealed to the outer ring of first and second dielectric layers 371,372 to protect the micro-switch 105. FIG. 4 shows the back of the second substrate 145 plated with metal in order to provide a ground which is, as stated above, electrically connected to the microcircuit's second ground layer 362.

Figure 5:
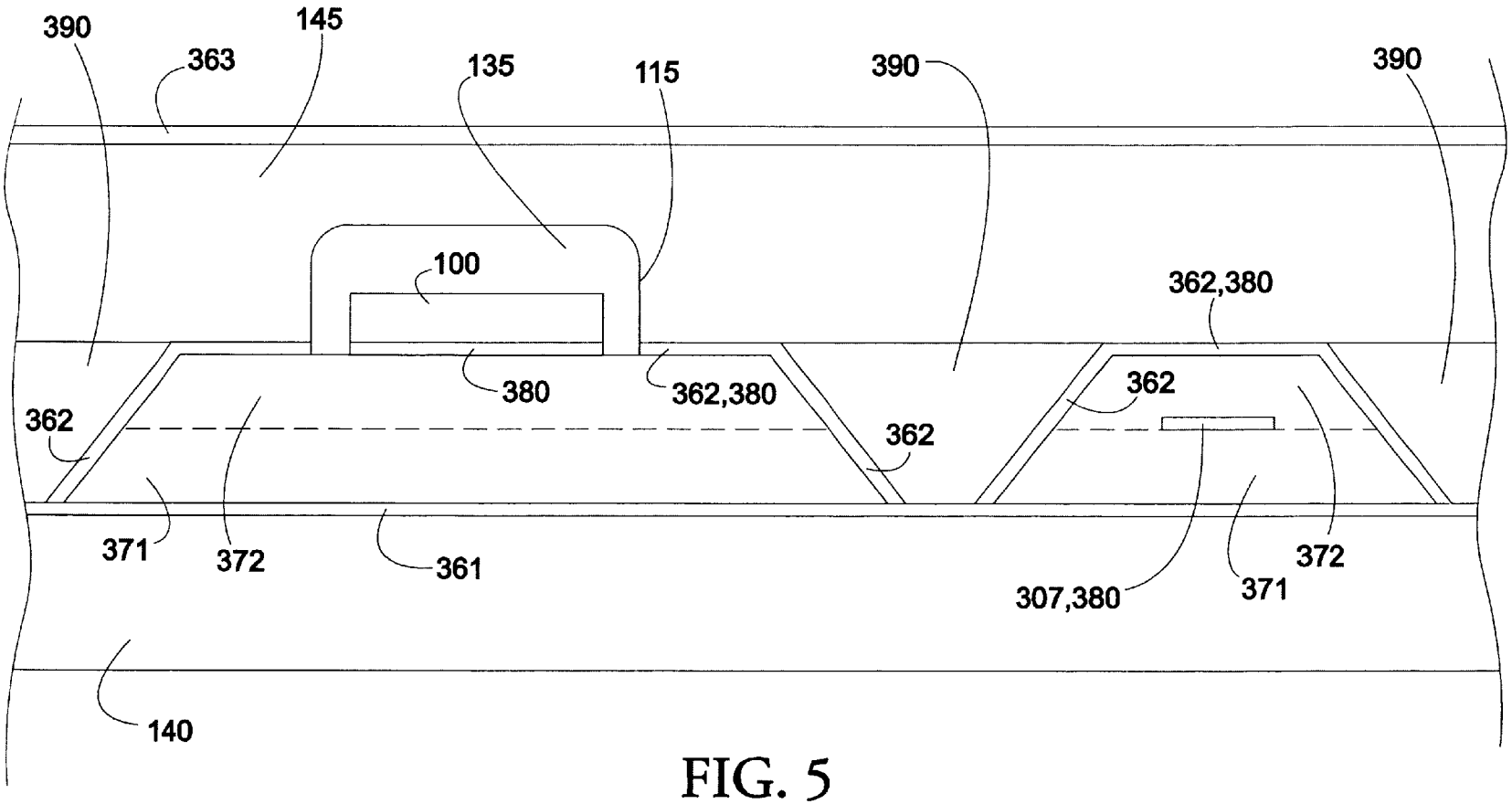
FIG. 5 is a drawing of a side view of the heater actuated, liquid metal micro-switch at section B—B of FIG. 3.

FIG. 5 is a drawing of a side view of the heater 100 actuated, liquid metal micro-switch 105 at section B—B of FIG. 3. FIG. 5 shows a cross-section taken through one of the heaters 100 of the liquid metal micro-switch 105. Again in FIG. 5, the first ground plane 361 is attached to a first substrate 140 with the first dielectric layer 371 being attached to the first ground plane 361. In FIG. 5, only the second signal conductor 307 which is attached to the first dielectric layer 371 and subsequently to the second dielectric layer 372, is shown from the conductive signal layer 380. The second ground plane 362 is attached to the first and second dielectric layers 371,372 and, in those areas not covered by first and/or second dielectric layers 371,372, to the first ground plane 361. The second substrate 145 is attached to the second ground plane 362. The third ground plane 363 is attached to the second substrate 145. The heater 100 is attached to the second dielectric material 372 and resides in the cavity 135 of the second substrate 145.

The first and second dielectric layers 371,372, the second signal conductor 307 patterned in the conductive signal layer 380, and the first and second ground planes 361,362 form a quasi-coax shielded transmission line. As in FIG. 4, FIG. 5 shows the back of the second substrate 145 plated with metal in order to provide a ground which is electrically connected to the microcircuit's second ground plane 362. Thus, except for the quasi-coax transmission line switch inputs and outputs indicated as first, second, and third signal conductors 306,307,308, the micro-switch 105 is completely surrounded by conductors at ground potential.

The resistive heaters 100 are deposited on the second dielectric layer 372, which with first dielectric layer 371 acts as a thermal barrier between the heater 100 and the first substrate 140, thereby increasing the efficiency of the heater 100. The heater cavity 115 is formed in the second substrate 145. The dielectric layers 371,372 are completely shielded electrically by the combination of the second and third ground planes 362,363. Note that the heaters 100 could also be placed on the first dielectric layer 371, and the heater cavity 115 could be formed by the absence of the second dielectric layer 372 above the heater 100. First and second heater contacts 101,102 which supply electrical power to the heaters 100 are not shown in FIGS. 3–5 but could be fabricated on top of the first dielectric layer 371 with vias through the second dielectric layer 372 to connect electrical power to the heaters 100 which are fabricated on top of the second dielectric layer 372.

Figure 6:
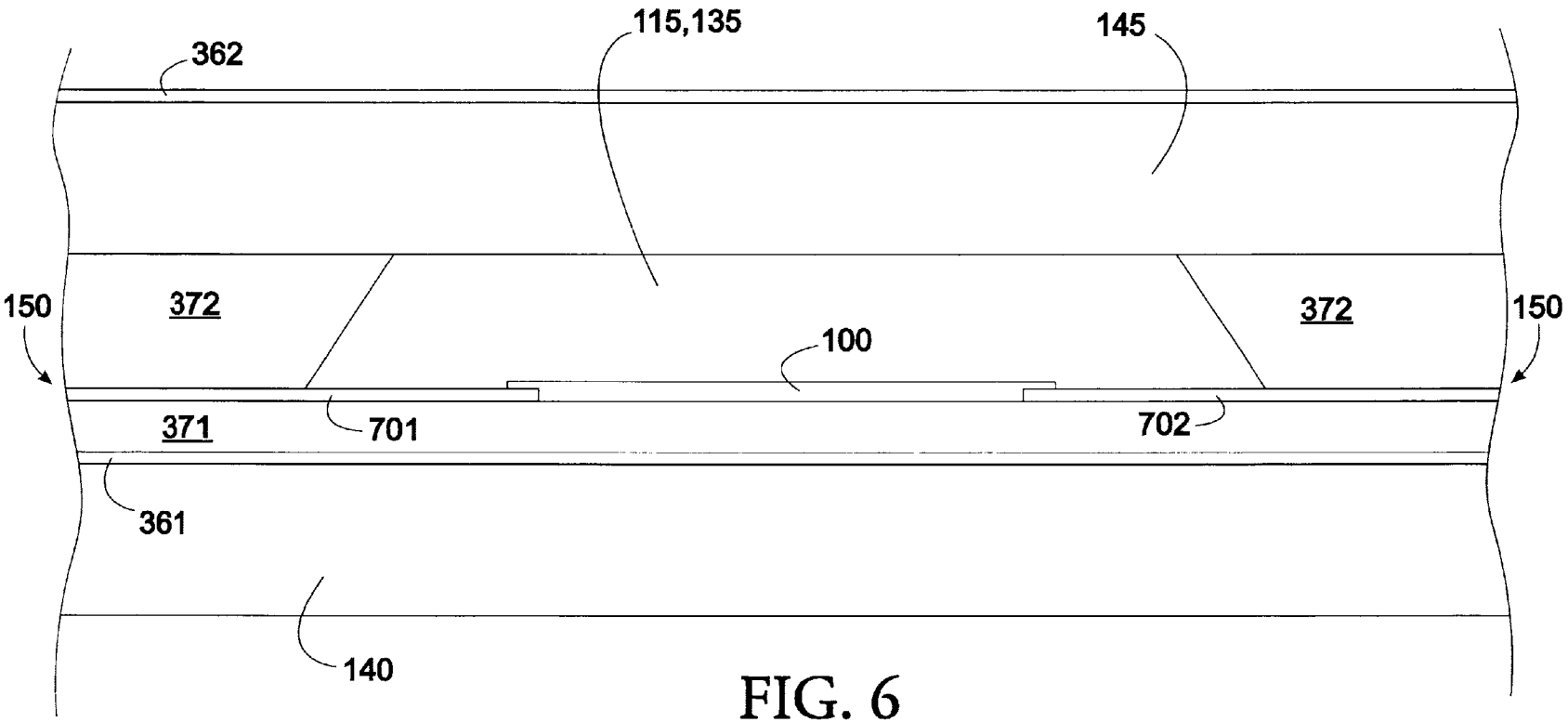
FIG. 6 is a drawing of a side view of the heater actuated, liquid metal micro-switch at section B—B of FIG. 3 in an alternative construction.

FIG. 6 is a drawing of a side view of the heater 100 actuated, liquid metal micro-switch 105 at section B—B of FIG. 3 in an alternative construction. FIG. 6 shows a cross-section taken through one of the heaters 100 of the liquid metal micro-switch 105. The first ground plane 361 is attached to a first substrate 140 with the first dielectric layer 371 being attached to the first ground plane 361. The first substrate 140 could be, for example, 96% alumina ceramic. The first dielectric material is preferably KQ-120 or KQ-CL907406 mentioned above. First and second heater conductors 701,702 are attached to the first dielectric layer 371 and make electrical contact to the heater 100 which is also attached to the first dielectric layer 371. Second ground plane 362 is attached to one side of the second substrate 145, which also could be, for example, 96% alumina ceramic. The second dielectric layer 372 is attached to the other side of the second substrate 145 with a cavity 115 having been formed by the appropriate removal of material from the second substrate 145. Again in operation, the cavity 115 is filled with a gas 135 which preferably should be an inert gas, as for example nitrogen. The second dielectric layer 372 is attached as appropriate to first and second heater conductors 701,702 and to the first dielectric layer 371 with hermetic seals as appropriate at mating surfaces 150.

The resistive heaters 100 are deposited on the first dielectric layer 371, which acts as a thermal barrier between the heater 100 and the first substrate 140, thereby increasing the efficiency of the heater 100. The heater cavity 115 is formed in the second dielectric layer 372 which is attached to the second substrate 145. The dielectric layers 371,372 can 15 be almost completely shielded electrically by the combination of the first and second ground planes 361,362. First and second heater contacts 101,102 which supply electrical power to the heaters 100 are not shown in FIG. 6 but could be fabricated with vias through the first dielectric layer 371 to connect electrical power to the heaters 100.

Figure 7:
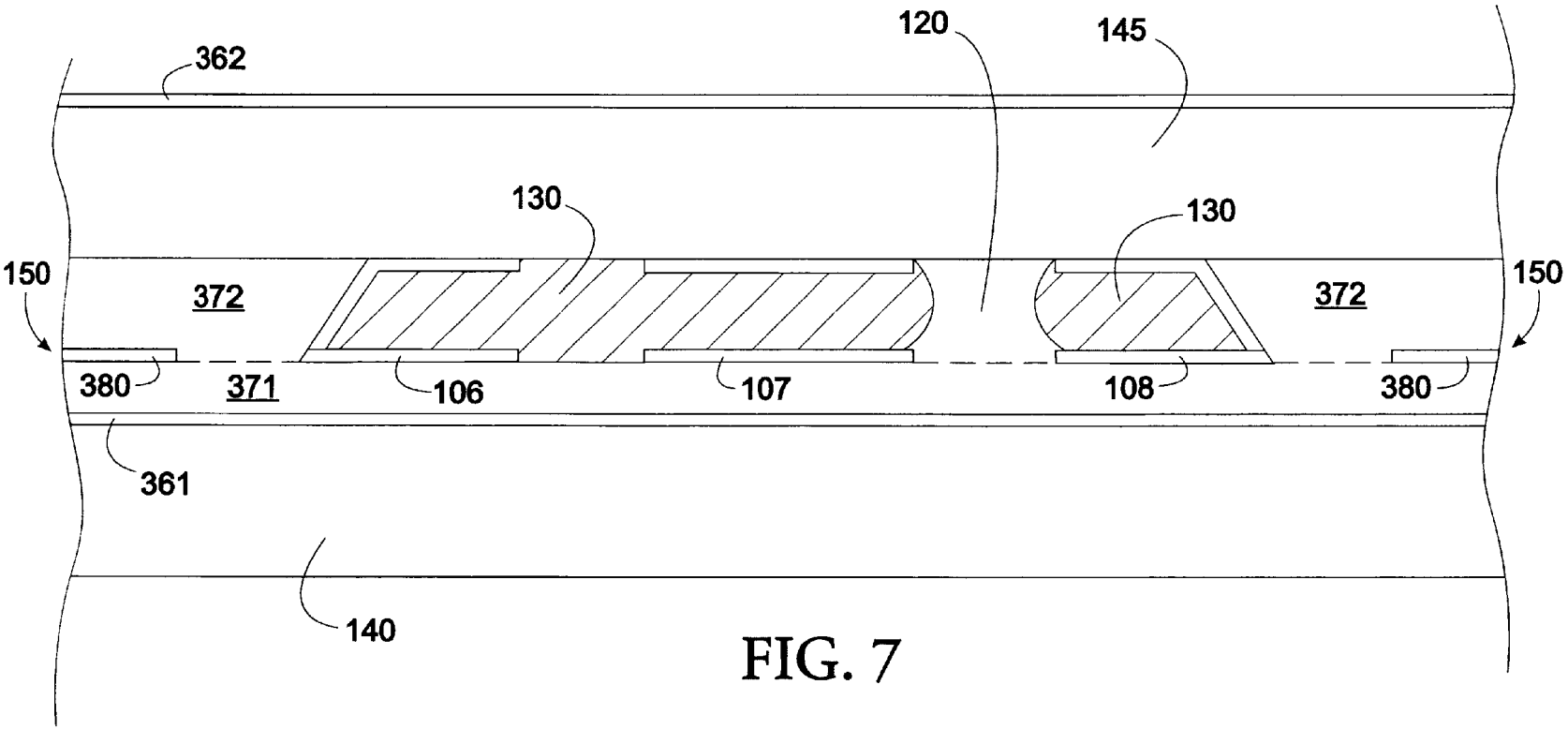
FIG. 7 is a drawing of a side view of the heater actuated, liquid metal micro-switch at section A—A of FIG. 3 in an alternative construction.

FIG. 7 is a drawing of a side view of the heater actuated, liquid metal micro-switch 105 at section A—A of FIG. 3 in an alternative construction. FIG. 7 shows a cross-section of the micro-switch 105 taken through the main channel 120. In FIG. 6, the first ground plane 361 is attached to the first substrate 140 with the first dielectric layer 371 attached to the first ground plane 361. The first substrate 140 could be, for example, 96% alumina ceramic. The first dielectric material is preferably KQ-120 or KQ-CL907406 mentioned above. Second ground plane 362 is attached to one side of the second substrate 145, which also could be, for example, 96% alumina ceramic. The second dielectric layer 372 is attached to the other side of the second substrate 145 with a main channel 120 having been formed by the appropriate removal of material from the second substrate 145. Again in operation, the main channel 120 is partially filled with a liquid metal 130 which could be, for example mercury 130, an alloy comprising gallium 130, or other appropriate liquid. The second dielectric layer 372 is attached to the first dielectric layer 371 with hermetic seals as appropriate at mating surfaces 150. First, second, and third micro-switch contacts 106,107,108 are attached to first and second dielectric layers 371,372 and to the second substrate 145 as appropriate. As shown in the representative configuration of FIG. 7, the liquid metal 130 is shorting first and second micro-switch contacts 106,107 together while third micro-switch contact 108 is open circuited. Depending upon the configuration of the micro-switch 105, the liquid metal 130 forms a short circuit between first and second micro-switch contacts 106,107 or between second and third micro-switch contacts 107,108.

The first ground plane 361 is preferably printed on top of the first substrate 140 which is preferably fabricated from ceramic. In a representative embodiment, the first substrate 140 is a mechanical carrier for the microcircuit 110 but does not provide signal propagation support, as is the case with conventional microcircuits. In a similar manner, the second ground plane 362 is preferably printed on top of the second substrate 145 which is preferably fabricated from ceramic. In a representative embodiment, the second substrate 145 is a mechanical carrier for the microcircuit 110 but does not provide signal propagation support, as is the case with conventional microcircuits. Various techniques are available for the placement and patterning of the dielectric layers 371,372, the ground a planes 361,362, as well as any conducting layers, as for example the conductive signal layer 380, between the first and second dielectric layers 371,372. Preferably the dielectric layers 371,372, the conductive signal layer 380, and the first and second ground planes 361,362 are deposited via thick film techniques, patterns are defined photo lithographically, and the layers etched to form the desired patterns. The dielectric materials are preferably KQ-120 or KQ-CL907406 mentioned above. Hermetic seals are preferably provided appropriate at mating surfaces 150.

Figure 8:
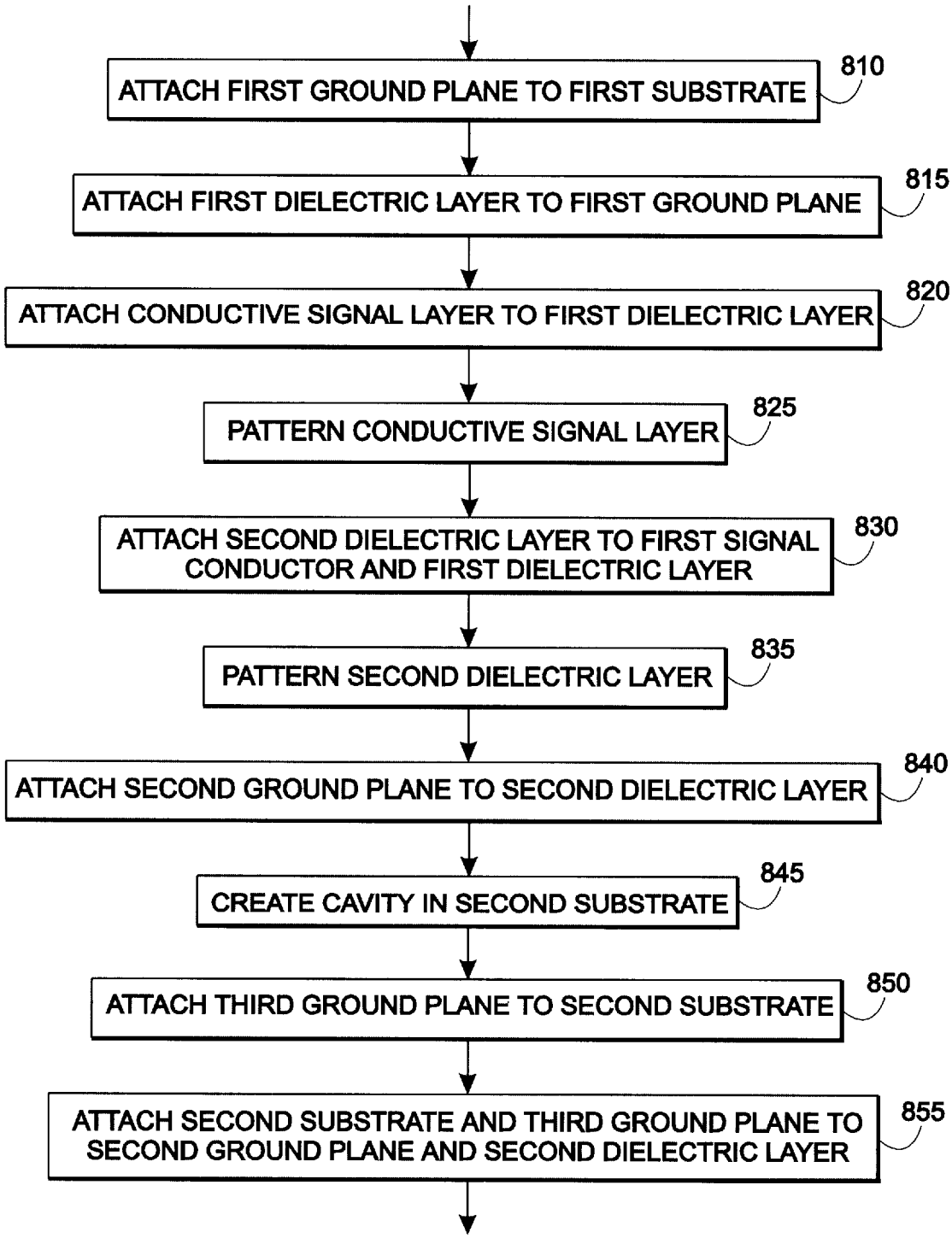
FIG. 8 is a drawing of a flow chart of a method for constructing a heater actuated, liquid metal micro-switch in a microcircuit as described in various representative embodiments consistent with the teachings of the invention.

FIG. 8 is a drawing of a flow chart of a method for constructing a heater 100 actuated, liquid metal micro-switch 105 in a microcircuit 110 as described in various representative embodiments consistent with the teachings of the invention.

In block 810, the first ground plane 361 is attached to the first substrate 140. Attachment of the first ground plane 361 to the first substrate 140 is preferably effected using thin film deposition techniques and/or thick film screening techniques. Block 810 then transfers control to block 815.

In block 815, the first dielectric layer 371 is attached to the first ground plane 361. Attachment of the first dielectric layer 371 to the first ground plane 361 is preferably effected using thin film deposition techniques and/or thick film screening techniques. Block 815, then transfers control to block 820.

In block 820, the conductive signal layer 380 is attached to the first dielectric layer 371. Attachment of the conductive signal layer 380 to the first dielectric layer 371 is preferably effected using thin film deposition techniques and/or thick film screening techniques. Block 820, then transfers control to block 825.

In block 825, the conductive signal layer 380 is patterned to form the first, second, and third signal conductors 306, 307,308, first second, and third micro-switch contacts 106, 107,108, and other conductors as needed in the microcircuit 110. Patterning of the conductive signal layer 380 is preferably effected using thin film deposition techniques and/or thick film screening techniques. Block 825, then transfers control to block 830.

In block 830, the second dielectric layer 372 is attached to the patterned conductive signal layer 380 and to the exposed areas of the first dielectric layer 371. Attachment of the conductive signal layer 380 to the patterned conductive signal layer 380 and to the exposed areas of the first dielectric layer 371 is preferably effected using thin film deposition techniques and/or thick film screening techniques. Block 830, then transfers control to block 835.

In block 835, the second dielectric layer 372 is patterned to expose first second, and third micro-switch contacts 106,107,108 and other conductors as needed in the microcircuit 110. Patterning of the second dielectric layer 372 is preferably effected using thin film deposition techniques and/or thick film screening techniques. Block 835, then transfers control to block 840.

In block 840, the second ground plane 362 is attached to the second dielectric layer 372. Attachment of the second ground plane 362 to the second dielectric layer 372 is preferably effected using thin film deposition techniques and/or thick film screening techniques. Block 840, then transfers control to block 845.

In block 845, the cavity 115 for the heaters 100, the sub-channels 125, and the main channel 120 are created in the second substrate 140. The cavity 115 for the heaters 100, the sub-channels 125, and the main channel 120 are created in the second substrate 140 preferably using hybrid circuit construction techniques well known to one of ordinary skill in the art. Block 845, then transfers control to block 850.

In block 850, the third ground plane 363 is attached to the second substrate 145. Attachment of the third ground plane 363 to the second substrate 145 is preferably effected using thin film deposition techniques and/or thick film screening techniques. Block 850, then transfers control to block 855.

In block 855, the third ground plane 363 and the second substrate 145 are attached to the second ground plane 362 and second dielectric layer 372 as appropriate. Attachment of the third ground plane 363 and the second substrate 145 to the second ground plane 362 and second dielectric layer 372 is preferably effected using hybrid circuit construction techniques well known to one of ordinary skill in the art. Block 855, then terminates the process.

Attaching the heaters 100 in the liquid metal micro-switch 105 has not been discussed in the above but could be effected via conventional die-attachment methods typically following the patterning of the second dielectric layer 372 in block 835. Other processes normally associated with such circuits, as for example wire bonding to the heaters 100, could also be performed at the appropriate times. Insertion of the liquid metal 130 in the main channel 120 also has not been discussed in the above but could be effected via conventional methods typically prior to attaching the third ground plane 363 and the second substrate 145 to the second ground plane 362 and second dielectric layer 372.

Figure 9:
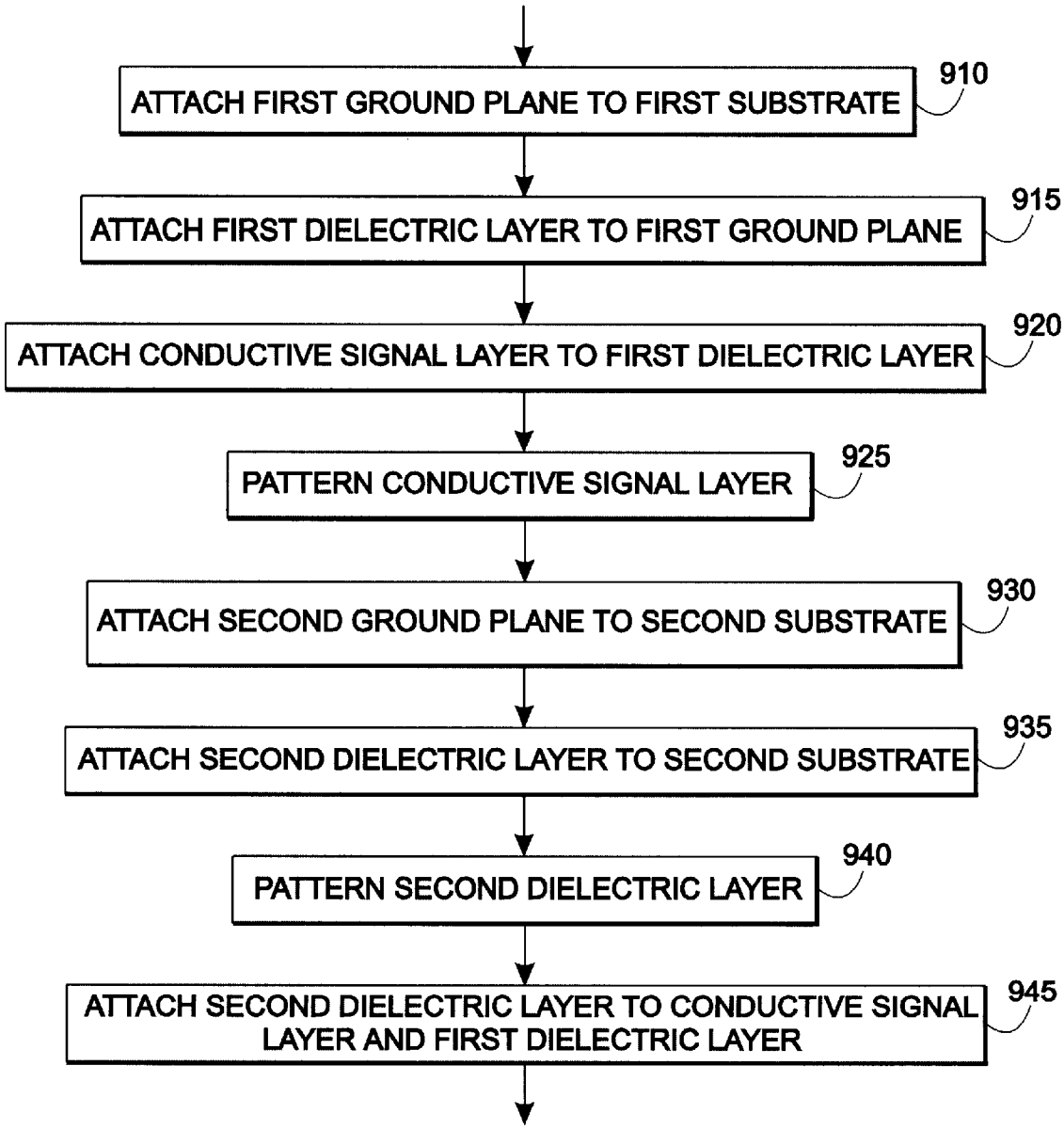
FIG. 9 is a drawing of a flow chart of another method for constructing a heater actuated, liquid metal micro-switch in a microcircuit as: described in various representative embodiments consistent with the teachings of the invention.

FIG. 9 is a drawing of a flow chart of another method for constructing a heater 100 actuated, liquid metal micro-switch 105 in a microcircuit 110 as described in various representative embodiments consistent with the teachings of the invention.

In block 910, the first ground plane 361 is attached to the first substrate 140. Attachment of the first ground plane 361 to the first substrate 140 is preferably effected using thin film deposition techniques and/or thick film screening techniques. Block 910 then transfers control to block 915.

In block 915, the first dielectric layer 371 is attached to the first ground plane 361. Attachment of the first dielectric layer 371 to the first ground plane 361 is preferably effected using thin film deposition techniques and/or thick film screening techniques. Block 915, then transfers control to block 920.

In block 920, the conductive signal layer 380 is attached to the first dielectric layer 371. Attachment of the conductive signal layer 380 to the first dielectric layer 371 is preferably effected using thin film deposition techniques and/or thick film screening techniques. Block 920, then transfers control to block 925.

In block 925, the conductive signal layer 380 is patterned to form the first, second, and third signal conductors 306, 307,308, first second, and third micro-switch contacts 106, 107,108, and other conductors as needed in the microcircuit 110. Patterning of the conductive signal layer 380 is preferably effected using thin film deposition techniques and/or thick film screening techniques. Block 925, then transfers control to block 930.

In block 930, the second ground plane 362 is attached to the second substrate 145. Attachment of the second ground plane 362 to the second substrate 145 is preferably effected using thin film deposition techniques and/or thick film screening techniques. Block 930 then transfers control to block 935.

In block 935, the second dielectric layer 372 is attached to the second substrate 145. Attachment of the second dielectric layer 372 to the second substrate 145 is preferably effected using thin film deposition techniques and/or thick film screening techniques. Block 935, then transfers control to block 940.

In block 940, the second dielectric layer 372 is patterned to create the cavity 115, the sub-channel 125, and the main channel 120. Patterning of the second dielectric layer 372 is preferably effected using thin film deposition techniques and/or thick film screening techniques. Block 940, then transfers control to block 945.

In block 945, the second dielectric layer 372 is attached to the conductive signal layer 380 and first dielectric layer 371 as appropriate. Attachment of the second dielectric layer 372 to the conductive signal layer 380 and first dielectric layer 371 is preferably effected using hybrid circuit construction techniques well known to one of ordinary skill in the art. Block 945, then terminates the process.

Attaching the heaters 100 in the liquid metal micro-switch 105 has not been discussed in the above but could be effected via conventional die-attachment methods typically following the patterning of the second dielectric layer 372 in block 835. Other processes normally associated with such circuits, as for example wire bonding to the heaters 100, could also be performed at the appropriate times. Insertion of the liquid metal 130 in the main channel 120 also has not been discussed in the above but could be effected via conventional methods typically prior to attaching the third ground plane 363 and the second substrate 145 to the second ground plane 362 and second dielectric layer 372.

A primary advantage of the embodiments as described in the present patent document over prior liquid metal micro-switches is the ability to integrate liquid metal micro-switches 105 directly into the construction of shielded thick film microwave modules. This integration is useful for applications requiring high frequency switching with high levels of electrical isolation. A microwave 130 dB-step attenuator is an example of an application for the disclosures provided herein.

While the present invention has been described in detail in relation to preferred embodiments thereof, the described embodiments have been presented by way of example and not by way of limitation. It will be understood by those skilled in the art that various changes may be made in the form and details of the described embodiments resulting in equivalent embodiments that remains within the scope of the appended claims.

What is claimed is:

1. A liquid metal micro-switch, comprising:

a first substrate;

a first ground plane attached to the first substrate;

a first dielectric layer attached to the first ground plane;

a conductive signal layer attached to the first dielectric layer and patterned so as to define first, second, and third signal conductors having respectively first, second, and third micro-switch contacts;

a second dielectric layer attached to the signal layer conductors and to the first dielectric layer;

a second ground plane attached to the second dielectric layer;

a second substrate attached to the second dielectric layer and having a cavity;

a third ground plane attached to the second substrate;

a heater positioned inside the cavity;

a main channel partially filled with a liquid metal, wherein the main channel encompasses the micro-switch contacts;

a sub-channel connecting the cavity and main channel, wherein a gas fills the cavity and sub-channel and wherein heater activation forces an open circuit between first and second micro-switch contacts and a short circuit between second and third micro-switch contacts.

2. The liquid metal micro-switch as recited in claim 1, further comprising:

an additional heater positioned inside an additional cavity;

an additional sub-channel connecting the additional cavity and main channel, wherein an additional gas fills the additional cavity and the additional sub-channel and wherein activation of the additional heater forces an open circuit between second and third micro-switch contacts and a short circuit between first and second micro-switch contacts.

3. The liquid metal micro-switch as recited in claim 2, wherein the additional gas is nitrogen.

4. The liquid metal micro-switch as recited in claim 1, wherein the first dielectric layer is a material selected from the group consisting of KQ-120 and KQ-CL907406.

5. The liquid metal micro-switch as recited in claim 1, wherein the second dielectric layer is a material selected from the group consisting of KQ-120 and KQ-CL907406.

6. The liquid metal micro-switch as recited in claim 1, wherein the gas is nitrogen.

7. The liquid metal micro-switch as recited in claim 1, wherein the liquid metal is selected from the group consisting of mercury and an alloy comprising gallium.

8. The liquid metal micro-switch as recited in claim 1, wherein the first substrate is a ceramic material.

9. The liquid metal micro-switch as recited in claim 1, wherein the second substrate a glass material.

10. The liquid metal micro-switch as recited in claim 1, wherein the second substrate is hermetically sealed to the second ground plane.

11. A liquid metal micro-switch, comprising:

a first substrate;

a first ground plane attached to the first substrate;

a first dielectric layer attached to the first ground plane;

a conductive signal layer attached to the first dielectric layer and patterned so as to define first, second, and third signal conductors having respectively first, second, and third micro-switch contacts;

a second substrate;

a second ground plane attached to the second substrate;

a second dielectric layer attached to the second substrate, having a cavity, and attached to the first dielectric layer;

a heater positioned inside the cavity;

a main channel partially filled with a liquid metal, wherein the main channel encompasses the micro-switch contacts;

a sub-channel connecting the cavity and main channel, wherein a gas fills the cavity and sub-channel and wherein heater activation forces an open circuit between first and second micro-switch contacts and a short circuit between second and third micro-switch contacts.

12. The liquid metal micro-switch as recited in claim 11, further comprising:

an additional heater positioned inside an additional cavity;

an additional sub-channel connecting the additional cavity and main channel, wherein an additional gas fills the additional cavity and the additional sub-channel and wherein activation of the additional heater forces an open circuit between second and third micro-switch contacts and a short circuit between first and second micro-switch contacts.

13. The liquid metal micro-switch as recited in claim 12, wherein the additional gas is nitrogen.

14. The liquid metal micro-switch as recited in claim 11, wherein the first dielectric layer is a material selected from the group consisting of KQ-120 and KQ-CL907406.

15. The liquid metal micro-switch as recited in claim 11, wherein the second dielectric layer is a material selected from the group consisting of KQ-120 and KQ-CL907406.

16. The liquid metal micro-switch as recited in claim 11, wherein the gas is nitrogen.

17. The liquid metal micro-switch as recited in claim 11, wherein the liquid metal is selected from the group consisting of mercury and an alloy comprising gallium.

18. The liquid metal micro-switch as recited in claim 11, wherein the first substrate is a ceramic material.

19. The liquid metal micro-switch as recited in claim 11, wherein the second substrate is a ceramic material.

20. The liquid metal micro-switch as recited in claim 11, wherein the second substrate is hermetically sealed to the second ground plane.

21. A method for fabricating a liquid metal micro-switch, comprising:

attaching a first ground plane to a first substrate;

attaching a first dielectric layer to the first ground plane;

attaching a conductive signal layer to the first dielectric layer;

patterning the conductive signal layer so as to define first, second, and third signal conductors having respectively first, second, and third micro-switch contacts;

attaching a second dielectric layer to the first, second, and third signal conductors and to the first dielectric layer;

patterning the second dielectric layer so as to define at least one sub-channels and a main channel;

attaching a second ground plane to the second dielectric layer;

creating a cavity in a second substrate;

attaching a third ground plane to the second substrate;

attaching a heater inside the cavity;

partially filling the main channel with a liquid metal, wherein the main channel encompasses the micro-switch contacts;

attaching the second substrate and the third ground plane to the second ground plane and the second dielectric layer.

22. A method for fabricating a liquid metal micro-switch, comprising:

attaching a first ground plane to a first substrate;

attaching a first dielectric layer to the first ground plane;

attaching a conductive signal layer to the first dielectric layer;

patterning the conductive signal layer so as to define first, second, and third signal conductors having respectively first, second, and third micro-switch contacts;

attaching a second ground plane to a second substrate;

attaching a second dielectric layer to the second substrate;

patterning the second dielectric layer so as to define a cavity, at least one sub-channel, and a main channel;

attaching a second dielectric layer to first, second, and third signal conductors and to the first dielectric layer;

attaching a heater inside the cavity;

partially filling the main channel a liquid metal, wherein the main channel encompasses the micro-switch contacts; and attaching the second dielectric layer to the conductive signal layer and to the first dielectric layer.

* * * * *